US011400458B2

(12) United States Patent
Kirkpatrick et al.

(10) Patent No.: US 11,400,458 B2
(45) Date of Patent: Aug. 2, 2022

(54) PROCESS AND EQUIPMENT ASSEMBLY FOR BENEFICIATION OF COAL DISCARDS

(71) Applicants: Robin Duncan Kirkpatrick, Guateng (ZA); Colin Jurie Lotter, Guateng (ZA); Johann Anton Schneider, Guateng (ZA)

(72) Inventors: Robin Duncan Kirkpatrick, Guateng (ZA); Colin Jurie Lotter, Guateng (ZA)

(73) Assignee: Green Coal Technologies (Pty.) Ltd., Gauteng (ZA)

( * ) Notice: Subject to any disclaimer, the term of this patent is extended or adjusted under 35 U.S.C. 154(b) by 0 days.

(21) Appl. No.: 16/972,864

(22) PCT Filed: Jun. 5, 2019

(86) PCT No.: PCT/IB2019/054670
§ 371 (c)(1),
(2) Date: Dec. 7, 2020

(87) PCT Pub. No.: WO2019/234650
PCT Pub. Date: Dec. 12, 2019

(65) Prior Publication Data

US 2021/0245168 A1 Aug. 12, 2021

(30) Foreign Application Priority Data

Jun. 8, 2018 (ZA) ..... 2018/03882

(51) Int. Cl.
*B03B 1/04* (2006.01)
*B03B 9/00* (2006.01)
(Continued)

(52) U.S. Cl.
CPC ..... *B03B 1/04* (2013.01); *B03B 9/005* (2013.01); *C10L 5/04* (2013.01); *C10L 9/00* (2013.01);
(Continued)

(58) Field of Classification Search
CPC ..... B03B 1/04; B03B 9/005; C10L 2290/22; C10L 2290/24; C10L 2290/28;
(Continued)

(56) References Cited

U.S. PATENT DOCUMENTS 4,384,650 A 5/1983 Wright
4,964,576 A * 10/1990 Datta ..... B02C 17/16 209/168
(Continued)

FOREIGN PATENT DOCUMENTS

GB 2046131 11/1980
GB 2184036 6/1987

OTHER PUBLICATIONS

International Search Report for PCT/IB2019/054670 dated Aug. 26, 2019, 5 pages.
(Continued)

*Primary Examiner* — Ellen M McAvoy
*Assistant Examiner* — Chantel L Graham
(74) *Attorney, Agent, or Firm* — Venable LLP

(57) ABSTRACT

According to the invention, there is provided a process for the beneficiation of coal discards by increasing calorific value and carbon content while removing inert mineral matter and sulphur compounds. The process involves the pretreatment of wash water with a non-ionic kinetically energized surface-active agent and the admixture with a fixed mass of raw coal discard to enhance hydrophobicity and carboniferous particle agglomeration. Processing of the resulting suspension though a dedicated series of spiral
(Continued)

separators and high frequency, resonance sieves reliably reduces excessive levels of mineral ash and sulphur compounds.

40 Claims, 2 Drawing Sheets

(51) Int. Cl.
*C10L 5/04* (2006.01)
*C10L 9/00* (2006.01)

(52) U.S. Cl.
CPC ..... *C10L 2290/22* (2013.01); *C10L 2290/24* (2013.01); *C10L 2290/28* (2013.01); *C10L 2290/546* (2013.01)

(58) Field of Classification Search
CPC .. C10L 2290/44; C10L 2290/546; C10L 5/04; C10L 9/00
See application file for complete search history.

(56) References Cited

U.S. PATENT DOCUMENTS

| | | | | |
|---|---|---|---|---|
| 5,108,626 | A | 4/1992 | Lees et al. | |
| 5,535,892 | A | 7/1996 | Moorhead et al. | |
| 2003/0061766 | A1* | 4/2003 | Vogt | C09G 1/02 51/308 |
| 2008/0053914 | A1* | 3/2008 | Yoon | C10L 5/04 210/710 |
| 2008/0185146 | A1* | 8/2008 | Baycroft | E21B 43/04 166/278 |
| 2017/0355880 | A1* | 12/2017 | Smith | C09K 3/1463 |

OTHER PUBLICATIONS

Written Opinion of the ISA for PCT/IB2019/054670 dated Aug. 26, 2019, 4 pages.

* cited by examiner

PROCESS AND EQUIPMENT ASSEMBLY FOR BENEFICIATION OF COAL DISCARDS

This application is the U.S. national phase of International Application No. PCT/IB2019/054670 filed Jun. 5, 2019 which designated the U.S. and claims priority to ZA Patent Application No. 2018/03882 filed Jun. 8, 2019, the entire contents of each of which are hereby incorporated by reference.

BACKGROUND TO THE INVENTION

For the purpose of this background information, the discussion will focus on coal beneficiation. Similar problems present with the beneficiation of other fine, non-carbonaceous mineral resources.

Raw coal exists in a water-saturated and oxygen-free environment. Coal extraction activities destabilise the physical and chemical integrity of coal products and initiate a progressive deterioration of its combustion performance and economic value. A direct consequence of thermal coal extraction and preparation is the concomitant generation of significant quantities of duff, discard and slurry coal. While it is estimated that more than 50% of these bi-products could have energy application purposes, they may also contain varying amounts of moisture, sulphur and mineral ash, which would limit their economic suitability for further processing and supply into carbon-based energy generation systems.

The overall aim of coal beneficiation is to create a high calorific value carbonaceous fuel which is substantially free of moisture, with reduced ash and sulphur content. In most instances manipulation of coal fines results in conversion of the outer surface of coal particulates to a state of hydrophobicity through dewatering. This singular feature dictates the associated physicochemical attributes of the processed particle and describes the calorific, and hence commercial, value of a final washed product.

One of the main reasons for the minimal use of discard and washed coal slurry is the oxidative deterioration of the calorific content of coal as a result of the extended exposure to surface environmental influences, such as moisture from rainfall and ambient oxygen. Progressive oxidative deterioration of exposed coal fines exerts a direct and inversely negative impact on hydrophobicity of potentially extractable calorific fractions within coal slurries and discards. This feature also has a direct adverse impact on the selective mobilisation of ultrafine coal particulates.

A diverse array of processing procedures, equipment configurations, chemical additives and associated methodologies have been accorded definitive prior art status for the beneficiation of coal fines and slurries. Conventional technologies use the introduction and manipulation of air pressure to create a froth to promote selective separation of carbonaceous material to the surface (e.g. U.S. Pat. No. 6,632,258 B1). Alternatively, froth flotation may be potentiated with polyorganosiloxanes (European Pat. No. 0164237 A2); may include fatty acids and derivatives (U.S. Pat. No. 8,925,729 B2); agglomerating oil (U.S. Pat. Nos. 4,758,332 A; 5,035,721 A); or a liquid hydrocarbon in combination with continuous air agglomeration (U.S. Pat. No. 6,126,014 A). U.S. Pat. No. 4,412,842 discloses a method of coal beneficiation using intense sonic agitation with gravitational separation.

Fundamentally, a beneficiation process of coal discards requires that particulate coal bi-products are washed in an aqueous phase. The resultant suspension of slurry and/or fine coal discards in water is then subjected to either a mechanical or mechano-chemical manipulation in order to destabilise the surface physico-chemical properties of the fine particle suspension. This results in separation of suspended particulates out of the wash water to permit selective harvesting of the high calorific value carbon-based fraction of the particulates.

The core of selective mobilisation of carbonaceous particulates within an aqueous suspension from contaminating, non-carbonaceous ash and inorganic compounds initially requires vigorous dispersion to enhance particulate hydrophobicity, followed by mechanical or mechano-chemical aggregation and separation. These manipulations may comprise of procedures such as sedimentation, flotation, flocculation, filtration etc. and may be employed separately or in a variety of combinations. In addition to essentially mechanical separation of different components of the high-value carbon-based particles from non-calorific soils, for example by sieving, dewatering, spirals and cyclones, further manipulations of electrodynamic properties of the aqueous phase of slurries and discard streams can be achieved with surface-active chemical compounds that impact upon the electrical charges of the coal particles. As before, these interventions may be employed separately or in combination.

A limitation to the economic viability for reclamation and beneficiation of these discards and slurry aggregates (heaps and ponds), is the lack of appropriate technology and capital available for dedicated equipment capable of turning the duff, discard and coal slurry into a commercially viable product. Further beneficiation costs along with the high cost of transport and the relatively cheap price of coal, mitigate against selective mobilisation of this ubiquitous resource associated with most long-term coal mining operations.

In addition, protracted and extensive historical exploitation of open-cast and underground sources of high-grade coal reserves has reduced the ready availability of minimally optimal calorific grades of coal. Progressively declining coal reserves and the preponderance of low calorific value discards largely precludes their suitability for direct integration into existing conventional pulverised coal injection environments.

The applicant aims to provide a solution which will alleviate at least some of the shortcomings associated with current beneficiation processes by providing a customized process flow and equipment design for the beneficiation of coal discards to meet commercial grade product requirements.

SUMMARY OF THE INVENTION

According to a first aspect of the invention there is provided a continuous process for beneficiating coal particulates selectively to extract and increase yield of high calorific value carbon components from undesirable fractions of a raw coal feed, the process comprising the steps of— pretreating wash water by delivering an amount of a non-ionic surfactant to a wash water tank effective to shift the wash water to a reducing oxidation-reduction-potential such that the wash water has a pH in a range of from about 2.0 to 8.6 and an oxidation-reduction-potential of from about +200 mV to about +400 mV;

introducing the raw coal feed and pretreated wash water into a primary mixing tank and washing the coal particulates with the pretreated wash water so as selectively to alter surface electrostatic charges of the coal particulates and increase their hydrophobic mobilization; and separating the high calorific value carbon particulates from the wash water.

The raw coal feed may comprise raw coal particulates, coal fines and/or coal slurry.

The non-ionic surfactant may be an amphipathic, non-ionic surfactant, emulsifier, wetting agent and lubricant. More particularly, the non-ionic surfactant may be a short-chained, ethoxylated and propoxylated alcohol base surfactant. The concentration of the non-ionic surfactant in the pretreated wash water may be between 0.0007% and 0.0033% v/v or between 8.86 and 33.3 ppb (parts per billion). The alcohol base surfactant may have a branched and linear carbon chain length of between 12 and 15 molecules. The pro-active inclusion of this pre-treatment surfactant serves to manipulate the properties of the aqueous phase of the coal-wash water slurry in the primary mixing tank so as to potentiate mechanical separation of different particulate fractions during further extraction.

The pretreated wash water may be admixed with the raw coal particulate feed such that the coal-wash water slurry (i.e. after addition of the pretreated wash water) has a pH in a range of from about 2.0 to about 8.5 and an oxidation-reduction-potential of from about +500 mV to about +600 mV.

The process may provide admixing the pretreated wash water with the raw coal particulate feed so as to create a coal-wash water slurry mass percentage of approximately 4:1 and 6:1 solids to water ratio, and approximately 80% w/v to 86% w/v solids by weight. The raw coal particulate feed may be admixed with the pretreated wash water at a rate of between approximately 4:1 and 6:1; and volume supply of between approximately 20% w/v and 14% w/v.

The process may include the additional steps of— vigorously agitating the coal-wash water slurry within the primary mixing tank;

transferring the coal-wash water slurry to a primary gravitational separator for primary separation of high calorific value coal particulates of more than 100 micrometers from smaller particles low calorific value discards; and transferring the high calorific value coal particulates to a primary high frequency resonance screen having a mesh size of no more than 100 micrometers for further dehydrating and separating high calorific value coal particulates from any remaining pretreated wash water and particulates of less than 100 micrometers.

The coal-wash water slurry within the primary mixing tank may be agitated at a frequency of approximately 900 RPM for a period of approximately 60 seconds to 90 seconds.

The coal-wash water slurry may be introduced into the primary gravitational separator at a material feed rate of approximately 1 ton to 120 tons per hour.

The primary gravitational separator may be a wet spiral separator having a cutter bar position set at approximately 100 micrometers. The wet spiral separator may be set to a separation specific gravity of 1.2 maximum. The process may provide assembling a number of primary spiral separators, either in series or parallel, for processing the pretreated water and coal slurry flow from the primary mixing tank across the primary high frequency screen for separation of high calorific value coal particulates of more than 100 micrometers from smaller particles of low calorific value discards.

The process may provide the additional steps of— introducing the high calorific value coal particulates that are collected from the primary high frequency resonance screen into a secondary mixing tank and washing the so-collected high calorific value coal particulates with pretreated or untreated wash water during a continuous secondary beneficiation stage; and further separating the high calorific value carbon particulates from the wash water.

The continuous process may include the additional steps of— vigorously agitating the high calorific value carbon particulates and pretreated or untreated wash water slurry within the secondary mixing tank;

transferring the high calorific value carbon particulates and wash water slurry to a secondary gravitational separator for secondary separation of high calorific value coal particulates of more than 100 micrometers from smaller particles of low calorific value discards; and transferring the high calorific value coal particulates to a secondary high frequency resonance screen having a mesh size of no more than 100 micrometers for further dehydrating and separating high calorific value coal particulates from any remaining wash water and particulates of less than 100 micrometers.

The coal-wash water slurry within the secondary mixing tank may be agitated for a period of approximately 90 seconds.

The coal-wash water slurry may be introduced into the secondary gravitational separator at a material feed rate of a minimum of 1 ton per hour.

The secondary gravitational separator may be a wet spiral separator having a cutter bar position set at approximately 100 micrometers. The wet spiral separator may be set to a separation specific gravity of 1.2 maximum. The process may provide assembling a number of secondary spiral separators in series and running an output of a first spiral separator through a second separator for further secondary separation of high calorific value coal particulates of more than 100 micrometers from smaller particles low calorific value discards. The process may include introducing more secondary spiral separators in series.

Spent wash water which is collected after gravitational and screen separation may contain both ultrafine coal and ash particulates and wash water. The process may include the further step of transferring such spent wash water to an underflow tailings tank; allowing the spent wash water to settle so as to separate fine coal particulates and ash from the wash water; and reintroducing the so-separated wash water back into the beneficiation process of the invention.

According to a second aspect of the invention there is provided a batch process for beneficiating high calorific value coal particulates from undesirable fractions of a raw coal feed, the process comprising the steps of— pretreating wash water by delivering an amount of a non-ionic surfactant to a wash water tank effective to shift the wash water to a reducing oxidation-reduction-potential such that the wash water has a pH in a range of from about 2.0 to about 8.6 and an oxidation-reduction-potential of from about +200 mV to about +400 mV;

introducing the raw coal feed and pretreated wash water into a primary mixing tank and washing the coal particulates with the pretreated wash water so as selectively to alter surface electrostatic charges of the coal particulates and increase their hydrophobic mobilization;

transferring the coal-wash water slurry to a primary gravitational separator for primary separation of high calorific value coal particulates of more than 100 micrometers from smaller particles of low calorific value discards;

transferring the high calorific value coal particulates to a primary high frequency resonance screen having a mesh size of no more than 100 micrometers for further dehydrating and separating high calorific value coal particulates from any remaining pretreated wash water and particulates of less than 100 micrometers;

introducing the high calorific value coal particulates that are collected from the primary high frequency resonance screen back into the primary mixing tank and washing the so-collected high calorific value coal particulates with pretreated or untreated wash water during a secondary beneficiation stage; and separating the high calorific value carbon particulates from the wash water through the primary gravitational separator and primary high frequency resonance screen.

The process is adapted for beneficiation of coal discards from a diverse array of coal types, inorganic compounds, moisture and diverse soil and clay contents. The applicant believes that the high calorific value carbon particulates that are extracted according to the invention are substantially free of moisture and have reduced ash and sulphur contents as compared to the raw coal discards. The applicant has found that inclusion of the surfactant and the ensuing physicochemical changes to the pretreated wash water, and by consequence the behaviour of the progressively separable particulates (i.e. de-agglomeration) in the coal slurry, results in a significantly higher degree of beneficiation. The unique approach of measuring oxidation-reduction potential and pH under significantly variable global conditions results in substantially enhanced predictability in terms of calorific yield percentage, capacity to remove unwanted colloidal/clay ash compounds, and to reduce sulphur compounds inherent in raw or discard coal slurries.

According to a third aspect of the invention there is provided a process for beneficiating high value particulates to selectively extract and increase yield of high value mineral components from undesirable fractions of a raw mineral feed, the process comprising the steps of— pretreating wash water by delivering an amount of a non-ionic surfactant to a wash water tank effective to shift the wash water to a reducing oxidation-reduction-potential such that the wash water has a pH in a range of from about 2.0 to about 8.6 and an oxidation-reduction-potential of from about +200 mV to about +400 mV;

introducing the raw mineral feed and pretreated wash water into a primary mixing tank and washing the mineral particulates with the pretreated wash water so as selectively to alter surface electrostatic charges of the mineral particulates and increase their hydrophobic mobilization; and separating the high value mineral particulates from the wash water.

The raw mineral feed may comprise high value non-calorific particulates, including but not restricted to gold, silver, PGMs, zinc and chromium.

The process may include the additional steps of— vigorously agitating the minerals-wash water slurry within the primary mixing tank;

transferring the minerals-wash water slurry to a primary gravitational separator for primary separation of high value mineral particulates from smaller particles of low value discards; and transferring the high value mineral particulates to a primary high frequency resonance screen for further dehydrating and separating high value mineral particulates from any remaining wash water and undesirable small particulates.

The process may provide the additional steps of— introducing the high value mineral particulates that are collected from the primary high frequency resonance screen into a secondary mixing tank and washing the so-collected high value mineral particulates with pretreated or untreated wash water during a secondary beneficiation stage; and separating the high value mineral particulates from the wash water.

The process may include the additional steps of— vigorously agitating the high value mineral particulates and wash water slurry within the secondary mixing tank;

transferring the high value mineral particulates and wash water slurry to a secondary gravitational separator for secondary separation of high value mineral particulates from smaller particles low value discards; and transferring the high value mineral particulates to a secondary high frequency resonance screen for further dehydrating and separating high value mineral particulates from any remaining wash water and smaller particulates.

According to a fourth aspect of the invention there is provided a coal beneficiation equipment assembly for use in a process for beneficiating coal particulates to selectively extract and increase yield of high calorific value carbon components from undesirable fractions of a raw coal feed, the equipment assembly comprising— a pretreatment wash water tank for pretreating wash water;

a primary mixing tank arranged in flow communication with the pretreatment wash water tank and configured for receiving the raw coal feed and pretreated wash water;

agitating means operatively associated with the primary mixing tank and configured for washing the coal particulates with the pretreated wash water so as selectively to alter surface electrostatic charges of the coal particulates and increase their hydrophobic mobilization;

a primary gravitational separator arranged in flow communication with the primary mixing tank for primary separation of high calorific value coal particulates of more than 100 micrometers from smaller particles of low calorific value discards;

a primary high frequency resonance screen arranged in flow communication with the primary gravitational separator and having a mesh size of no more than 100 micrometers for further dehydrating and separating high calorific value coal particulates from any remaining wash water and particulates of less than 100 micrometers; and an underflow tailings tank arranged in flow communication with the primary gravitational separator and primary high frequency resonance screen for receiving spent wash water.

The primary gravitational separator may be a wet spiral separator having a cutter bar position set at approximately 100 micrometers. The wet spiral separator may be set to a separation specific gravity of 1.2 maximum. The equipment assembly may include a number of primary spiral separators such that an output of a first spiral separator is run through a second separator for further primary separation of high calorific value coal particulates of more than 100 micrometers from smaller particles low calorific value discards.

The equipment assembly further may comprise— a secondary wash water tank containing either pretreated or untreated wash water;

a secondary mixing tank arranged in flow communication with the secondary wash water tank and the primary high frequency resonance screen and configured for receiving the high calorific value coal particulates that are collected from the primary high frequency resonance screen into the secondary mixing tank;

agitating means operatively associated with the secondary mixing tank and configured for washing the collected high calorific value coal particulates with pretreated or untreated wash water;

a secondary gravitational separator arranged in flow communication with the secondary mixing tank for secondary separation of high calorific value coal particulates of more than 100 micrometers from smaller particles low calorific value discards;

a secondary high frequency resonance screen arranged in flow communication with the secondary gravitational separator and having a mesh size of no more than 100 micrometers for further dehydrating and separating high calorific value coal particulates from any remaining wash water and particulates of less than 100 micrometers; and an underflow tailings tank arranged in flow communication with the secondary gravitational separator and secondary high frequency resonance screen for receiving spent wash water.

The equipment assembly may be in the form of a mobile rig.

According to a fifth aspect of the invention there is provided pretreated wash water adapted for use in a process for beneficiating coal particulates from a raw coal feed, the pretreated wash water including an amount of a non-ionic surfactant effective to shift the wash water to a reducing oxidation-reduction-potential such that the wash water has a pH in a range of from about 2.0 to about 8.6 and an oxidation-reduction-potential of from about +200 mV to about +400 mV.

The non-ionic surfactant may be an amphipathic, non-ionic surfactant, emulsifier, wetting agent and lubricant. More particularly, the non-ionic surfactant may be a short-chained, ethoxylated and propoxylated alcohol base surfactant. The alcohol base surfactant may have a branched and linear carbon chain length of between 12 and 15 molecules. The concentration of the non-ionic surfactant in the pretreated wash water may be between 0.0007% and 0.0033% v/v or between 8.86 and 33.3 ppb (parts per billion).

The invention extends to a high calorific value carbonaceous fuel comprising high calorific value carbon particulates extracted from a raw coal feed according to the process and equipment assembly of the invention.

SPECIFIC EMBODIMENTS OF THE INVENTION

Without limiting the scope thereof, the invention will now further be described and exemplified with reference to the accompanying examples and drawings in which—

The present invention provides a dedicated equipment design, customized process and pre-processing capacitation of the physicochemical characteristics of an aqueous phase of a washing process for the beneficiation of coal discards and have been designed to optimize reclamation of high calorific value carbonaceous particulates from a raw coal feed, while retaining all discards for further processing or validation of mass balance yield parameters. The process flow and mechanical configuration of FIGS. 1 and 2 describes a two-phase approach which is continuous and mutually inclusive.

Figure 1:
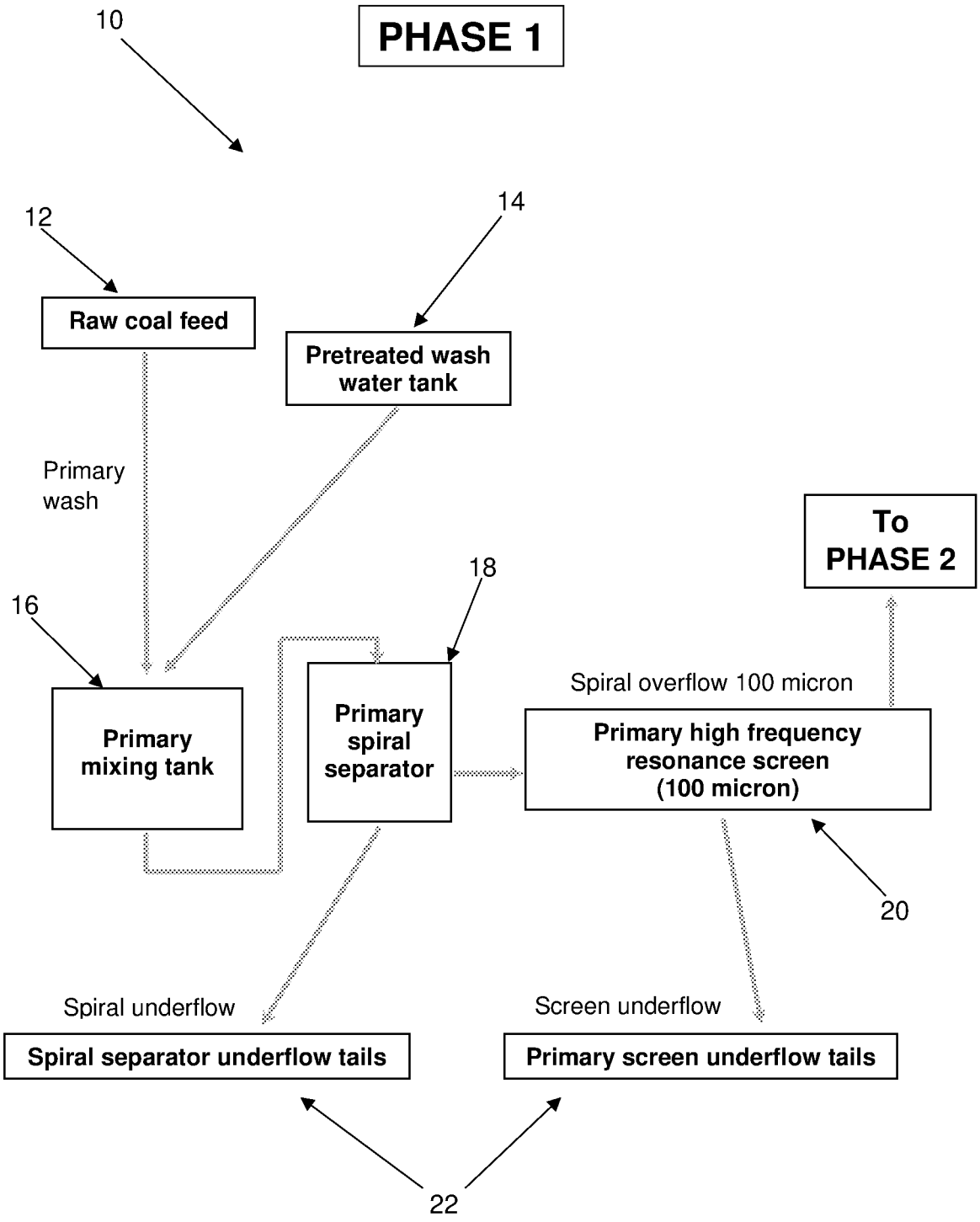
FIG. 1 is a process flow chart representing a first stage for the beneficiation of coal discards according to the invention.

The first process phase [10] of FIG. 1 comprises of a raw coal feed [12] fed into a primary mixing tank [16] including a motorized mixing paddle to agitate the coal discards, fines and/or slurry. Pretreated wash water is added to the primary mixing tank [16] from a wash water pretreatment tank [14]. The pre-treatment compound that is used for capacitation of the phase one wash water during particulate dispersion and hydrophobic mobilization comprises of a short chained, ethoxylated and propoxylated alcohol base which acts as an amphipathic, non-ionic surfactant, emulsifier, wetting agent and lubricant. From the primary mixing tank [16], the suspended coal-wash water slurry is pumped into a primary spiral separator [18]. The primary spiral separator [18] is preset to a separation specific gravity of 1.2 maximum to gravitationally separate impurities and water from the coal slurry.

The pro-active inclusion of the pre-treatment compound serves to manipulate the properties of the aqueous phase of the slurry mixture in the primary mixing tank [16] so as to potentiate the mechanical separation of the different particulate fractions within the primary spiral separator [18]. Further enhancement of particulate partitioning and selective extraction of high calorific value coal may be achieved with further integration of the pretreated water throughout the entire washing process.

Overflow from the primary spiral separator [18] is pumped to a high frequency resonance screen [20] with a mesh size of 100 micrometres. The resonance screen [20] further separates water and wastes from the coal slurry. All discards or underflow water [22] is harvested in tailings tanks (not shown) for settling of low calorific ash, clay rich fractions coal and water for subsequent re-use.

Figure 2:
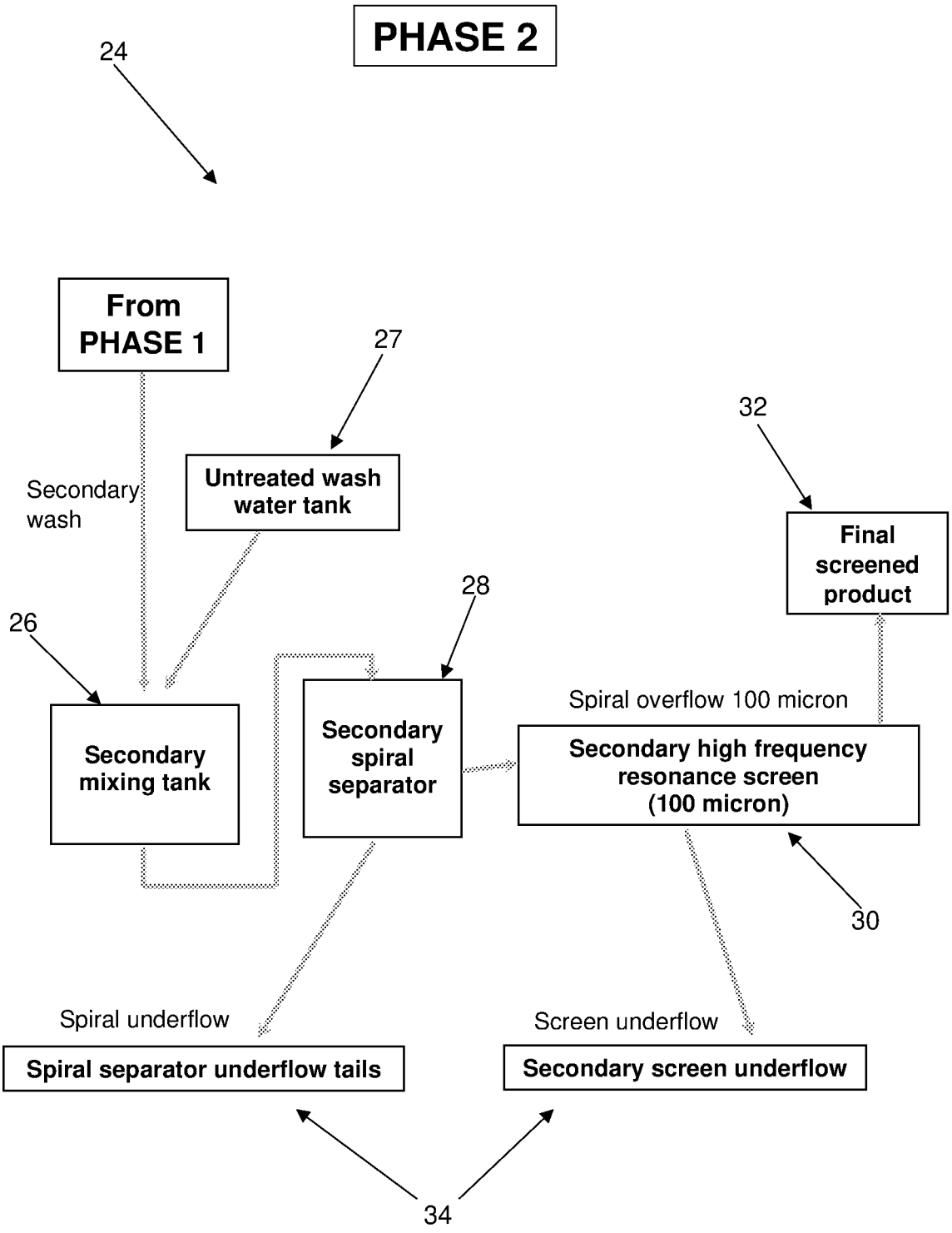
FIG. 2 is a process flow chart representing a second stage for the beneficiation of coal discards according to the invention.

The second process phase [24] of FIG. 2 is directly coupled to the infrastructure of the first phase [10], FIG. 1, components and is directly dependent on the outputs of the first phase [10], FIG. 1, to further refine the beneficiated product by processing through the second phase [24] structures. The second phase [24] comprises a secondary mixing tank [26] for receiving the beneficiated coal slurry of the first phase [10]. Treated or untreated wash water is added from a secondary wash water tank [27] to the secondary mixing tank [26] and the coal slurry is further agitated and washed.

From the secondary mixing tank [26], the coal slurry is pumped into a secondary spiral separator [28] preset to a separation specific gravity of 1.2 maximum, for another round of waste and coal slurry separation. Overflow from the secondary spiral separator [28] is pumped to a secondary high frequency resonance screen [30] with a mesh size of 100 micrometres to dehydrate the post spiral slurry mix. The final beneficiated coal product [32] is harvested from the secondary resonance screen [30]. All discards and spent underflow wash water [22; 34] are harvested in collection sumps (not shown) to reclaim wash water for re-use.

The applicant has found that a combination of pretreatment of the wash water to be used in the aqueous phase washing of the raw coal with the surfactant, the vigorous mechanical agitation of the raw coal and the pretreated wash water, and the mechanical process flow through the two phases of the process design provide consistently repeatable results in terms of the beneficiated coal. The enhanced beneficiation resulting from the process of the invention, suggests that pretreatment of the aqueous washing phase potentiates selective partitioning of different aspects of the raw coal feed product. It is universally acknowledged and has reliably been shown that selective removal of unwanted elements from the fine raw coal material, specifically Sulphur and Sulphur-based compounds, may adversely impact upon suitability of reclaimed wash water to be re-used during further ongoing washing and beneficiation processes. Progressive increases in acidity and a lowering of pH values traditionally render coal wash water unusable and may pose a significant environmental risk if allowed to discharge into natural water courses. By contrast, the technology and process of the invention have been shown to reduce Sulphur content of the final washed product, without an adverse impact on the quality of the reclaimed wash water. Within minor limits, this allows the bulk of the reclaimed water to be re-used for further raw material washing without hindrance to the extraction performance of the combined mechano-chemical beneficiation process.

Pretreatment of the aqueous phase of the wash water according to the invention selectively manipulates the physicochemical and electrodynamic properties of the suspended coal particulates, in that the surfactant formulation partitions and separates different components of the suspended raw coal particulates discard solution to promote extraction of commercially viable, high calorific value carbon elements to the exclusion of inorganic contaminants lacking in combustible capacity.

Based on the inclusive actions of the specific spiral design specifications and configuration, sieve porosity and agitation frequency, preconditioned slurry admixture rate as well as the rate and volume of the raw coal supply, the selective and predictable partitioning of the high commercial value carbon fraction from ash and non-combustible components of the raw slurry feed after dewatering through a specific micron porosity sieve and agitator/vibrator consistently results in attainment of the following washed coal quality objectives:

- Increased Calorific Value (CV) per unit mass
- Increased Fixed Carbon content per unit mass
- Increased combustible fraction (yield) per initial unit mass
- Reduced ash content per unit mass
- Reduced Sulphur content per unit mass The invention extends to the use of a coal fine and slurry beneficiating technology for application across a diverse array of coal types, inorganic compounds, moisture and diverse soil and clay contents. In addition, the same approach can be applied for the selective extraction and beneficiation of other unrelated and valuable fine minerals from unwanted impurities and contaminants.

A further advantage of this invention is that discard coal meets the CV requirements of Pulverised Fuel power station requirements and an additional benefit is that minimal milling is required to get the specified fineness for commercial suitability of the resource.

Example 1

A comparative test was conducted to evaluate capacity of the process configuration in combination with a pretreated aqueous wash solution to selectively extract high calorific value coal residues from a low-grade slurry mixture. Changes to the profile of commercially relevant parameters were recorded at each stage of the process and the sampling site can be correlated with the Process Flow Diagram detailed in FIG. 1. Samples were processed in accordance with a standard protocol which was adapted and refined relative to the specifications and quantities of the Raw Feed material.

| Sample Identity | Inherent Moisture % | Ash Content % | Volatile Matter % | Fixed Carbon % | Calorific Value MJ/Kg | Calorific Value Kcal/Kg | Total Sulphur % | Total Moisture % |
|---|---|---|---|---|---|---|---|---|
| RAW FEED GGV/MRF-DRY-RAW FEED Jun. 10, 2016 | 3.4 | 40.7 | 19.7 | 36.2 | 16.85 | 4024.55 | 0.81 | 9.1 |
| SCREEN 1 UNDERFLOW GGV/MRF-DRY-B SCR(1) Jun. 10, 2016 | 2.3 | 44.7 | 18.6 | 34.5 | 15.91 | 3800.04 | 0.98 | 33.1 |
| SCREEN 2 UNDERFLOW GGV/MRF-DRY-B SCR(2) Jun. 10, 2016 | 2.1 | 34.4 | 20.1 | 43.4 | 19.76 | 4719.59 | 0.64 | 34.9 |
| SPIRAL 1 UNDERFLOW TAILINGS GGV/MRF-DRY-B Spiral(1) Jun. 10, 2016 | 0.9 | 68.3 | 13.7 | 17.2 | 5.77 | 1378.14 | 1.56 | 24.0 |
| SPIRAL 2 UNDERFLOW TAILINGS GGV/MRF-DRY-B Spiral(2) Jun. 10, 2016 | 1.4 | 55.1 | 16.1 | 27.5 | 11.88 | 2837.49 | 0.73 | 28.4 |
| FINAL SCREENED PRODUCT GGV/MRF-DRY-B After Clean Coal | 1.9 | 20.7 | 24.3 | 53.2 | 24.96 | 5961.59 | 0.46 | 28.0 |

The technology and process protocol detailed a consistent increase in volatile matter, Fixed Carbon and calorific value between the raw and final screened product. At the same time, the technology consistently reduced inherent moisture, ash content and total sulphur contents.

| | Particle Size Analysis | | | | |
|---|---|---|---|---|---|
| Sample Identity | % | % | % | % | % |
| RAW FEED | +3 mm | +0.5 mm | +0.100 um | +0.045 mm | −0.045 mm |
| GGV/MRF-DRY-RAW FEED Jun. 10, 2016 | 0.0 | 23.4 | 32.8 | 13.6 | 30.1 |
| SCREEN 1 UNDERFLOW | +3 mm | +0.5 mm | +0.100 um | +0.045 mm | −0.045 mm |
| GGV/MRF-DRY-B SCR(1) Jun. 10, 2016 | 0.0 | 1.9 | 15.9 | 41.7 | 40.51 |
| SCREEN 2 UNDERFLOW | +3 mm | +0.5 mm | +0.100 um | +0.045 mm | −0.045 mm |
| GGV/MRF-DRY-B SCR(2) Jun. 10, 2016 | 0.0 | 0.6 | 31.0 | 30.3 | 38.10 |
| SPIRAL 1 UNDERFLOW | +3 mm | +0.5 mm | +0.100 um | +0.045 mm | −0.045 mm |
| TAILINGS GGV/MRF-DRY-B Spiral(1) Jun. 10, 2016 | 0.0 | 10.9 | 70.3 | 11.3 | 7.50 |
| SPIRAL 2 UNDERFLOW | +3 mm | +0.5 mm | +0.100 um | +0.045 mm | −0.045 mm |
| TAILINGS GGV/MRF-DRY-B Spiral(2) Jun. 10, 2016 | 0.0 | 17.5 | 78.5 | 3.5 | 0.50 |
| FINAL SCREENED | +3 mm | +0.5 mm | +0.100 um | +0.045 mm | −0.045 mm |
| PRODUCT GGV/MRF-DRY-B After Clean Coal | 0.0 | 43.5 | 55.0 | 1.0 | 0.50 |

The Particle Size Distribution (PSD) for the raw coal shifted from a greater than 100 μm percentage of 56% to a final screened product of 98% confirming improved handling capacity.

Example 2

An equivalent study to that described in Example 1 was performed at a geographically distant mine with a substantially different coal quality. The protocol was again refined to address the specific attributes of the coal discards to be processed.

| Sample Identity | Inherent Moisture % | Ash Content % | Volatile Matter % | Fixed Carbon % | Calorific Value M J/Kg | Calorific Value Kcal/Kg | Total Sulphur % | Total Moisture % |
|---|---|---|---|---|---|---|---|---|
| RAW FEED | | | | | 238.85 | | | |
| TWFN/MRF-Wet-Raw Feed | 2.7 | 33.2 | 20.1 | 44.0 | 19.84 | 4738.78 | 1.11 | 37.8 |
| SCREEN 1 UNDERFLOW TWFN/MRF-Wet-B/line Scr1 | 3.4 | 33.3 | 19.5 | 43.8 | 19.51 | 4659.96 | 0.82 | 46.6 |
| SCREEN 2 UNDERFLOW TWFN/MRF-Wet-B/line Scr2 | 2.9 | 20.0 | 23.0 | 54.1 | 24.81 | 5925.87 | 0.49 | 16.1 |
| SPIRAL 1 UNDERFLOW TAILINGS TWFN/MRF-Wet-B/line Spiral1 | 2.0 | 39.7 | 19.5 | 38.9 | 17.63 | 4210.93 | 1.19 | 34.8 |
| SPIRAL 2 UNDERFLOW TAILINGS TWFN/MRF-Wet-B/line Spiral2 | 2.6 | 45.9 | 17.4 | 34.1 | 14.66 | 3501.54 | 0.93 | 35.8 |
| FINAL SCREENED PRODUCT TWFN/MRF-Wet-B/line After C/Coal | 2.8 | 18.4 | 22.6 | 56.2 | 25.61 | 6116.95 | 0.48 | 34.0 |

The technology was able to reduce ash content and sulphur (moisture relatively unchanged). At the same time, it substantially increased the values of volatile matter, fixed carbon and calorific value relative to the raw sample.

| | Particle Size Analysis | | | | |
|---|---|---|---|---|---|
| Sample Identity | % | % | % | % | % |
| RAW FEED | +3 mm | +0.5 mm | +0.100 um | +0.045 mm | −0.045 mm |
| TWFN/MRF-Wet-Raw Feed | 0.0 | 7.5 | 28.1 | 18.0 | 46.37 |
| SCREEN 1 UNDERFLOW | +3 mm | +0.5 mm | +0.100 um | +0.045 mm | −0.045 mm |
| TWFN/MRF-Wet-B/line Scr1 | 0.0 | 0.8 | 5.7 | 26.1 | 67.51 |
| SCREEN 2 UNDERFLOW | +3 mm | +0.5 mm | +0.100 um | +0.045 mm | −0.045 mm |
| TWFN/MRF-Wet-B/line Scr2 | 0.0 | 0.3 | 58.4 | 30.2 | 11.00 |
| SPIRAL 1 UNDERFLOW TAILINGS | +3 mm | +0.5 mm | +0.100 um | +0.045 mm | −0.045 mm |
| TWFN/MRF-Wet-B/line Spiral1 | 0.0 | 4.8 | 40.6 | 21.4 | 33.24 |
| SPIRAL 2 UNDERFLOW TAILINGS | +3 mm | +0.5 mm | +0.100 um | +0.045 mm | −0.045 mm |
| TWFN/MRF-Wet-B/line Spiral2 | 0.0 | 13.9 | 80.7 | 4.7 | 0.68 |
| FINAL SCREENED PRODUCT | +3 mm | +0.5 mm | +0.100 um | +0.045 mm | −0.045 mm |
| TWFN/MRF-Wet-B/line After C/Coal | 0.2 | 31.9 | 66.4 | 1.5 | 0.09 |

The PSD for the raw coal shifted from a greater than 100 μm percentage of 35.6% to a final screened product of 98.3%, again confirming improved handling capacity.

Example 3

Thermal discard coal samples derived from a long-term dump were processed in accordance with an established protocol. This protocol comprised of various permutations, including different concentrations of water treatment compound (surfactant), to establish inclusion rate relative to the mass of coal discard to be processed, as well as relative to the Particle Size Distribution (PSD) profile of the sample in question. The results reflect the standardized dose and inclusion rate of the water treatment compound with the raw product in the mixing tanks.

The pre-wash "raw feed" coal profile description of the discard sample was confirmed before processing and the "washed coal" qualities of the washed and processed coal are detailed below:

| Raw Coal | | Washed Coal | |
|---|---|---|---|
| Parameter | Value Before | Value After | % Change |
| SAMPLE 1 | | | |
| CV (Mj/Kg) | 23.54 | 30.74 | +31 |
| Ash (%) | 31.3 | 12.9 | −59 |
| Volatiles (%) | 18.3 | 20.6 | +13 |
| Fixed Carbon (%) | 49.6 | 65.5 | +32 |
| Sulphur (%) | 1.9 | 1.25 | −34 |
| SAMPLE 2 | | | |
| CV (Mj/Kg) | 26.29 | 31.45 | +20 |
| Ash (%) | 24.1 | 10.5 | −57 |
| Volatiles (%) | 19.2 | 22.6 | +18 |
| Fixed Carbon (%) | 55.8 | 64.8 | +18 |
| Sulphur (%) | 1.51 | 1.19 | −21 |
| SAMPLE 3 | | | |
| CV (Mj/Kg) | 16.85 | 25.96 | +54 |
| Ash (%) | 40.7 | 18.0 | −53 |
| Volatiles (%) | 19.7 | 24.5 | +23 |
| Fixed Carbon (%) | 36.2 | 55.4 | +23 |
| Sulphur (%) | 0.81 | 0.46 | −43 |

-continued

| Raw Coal | | Washed Coal | |
|---|---|---|---|
| Parameter | Value Before | Value After | % Change |
| SAMPLE 4 | | | |
| CV (Mj/Kg) | 19.8 | 26.2 | +32 |
| Ash (%) | 33.2 | 16.4 | −50 |
| Volatiles (%) | 20.1 | 23.9 | +19 |
| Fixed Carbon (%) | 44.0 | 56.4 | +29 |
| Sulphur (%) | 1.11 | 0.48 | −58 |

The samples were processed through the washing system and the non-viable fractions were collected as discards at the different stages of the washing process. The final "washed coal" fraction was collected after discharge from the processing system and submitted for independent measurement of commercially relevant criteria. The technology consistently increased the Calorific Value (CV), Volatiles and Fixed carbon percentages, while reducing the Ash and Sulphur contents.

Example 4

Anthracite coal discard samples were derived from a dedicated slurry pond containing suspended coal and ash particles after having been flushed from a washing plant. The features of the preprocessed "Raw Feed" 'wet coal discards' and the processed "washed coal" had the following qualities and features:

| Raw Anthracite | | Washed anthracite | |
|---|---|---|---|
| Parameter | Before | After | % Change |
| SAMPLE 1 | | | |
| Ash (%) | 44.2 | 12.3 | −72.0 |
| Volatiles (%) | 8.9 | 5.1 | −42.6 |
| Fixed Carbon (%) | 42.6 | 79.3 | +46.2 |
| Sulphur (%) | 1.7 | 0.8 | −52.94 |
| SAMPLE 2 | | | |
| Ash (%) | 36.5 | 14.0 | −61 |
| Volatiles (%) | 7.6 | 5.0 | −34.2 |
| Fixed Carbon (%) | 54.1 | 75.8 | +28.6 |

-continued

| Raw Anthracite | | Washed anthracite | |
|---|---|---|---|
| Parameter | Before | After | % Change |
| Sulphur (%) | 1.9 | 0.8 | −57.8 |
| SAMPLE 3 | | | |
| Ash (%) | 42.3 | 18.9 | −55 |
| Volatiles (%) | 7.46 | 6.3 | −14.6 |
| Fixed Carbon (%) | 44.4 | 72.3 | +63 |
| Sulphur (%) | 2.59 | 1.02 | −59 |

The sample was prepared in accordance with the standard processing protocol and processed through the washing and separation system. The technology consistently reduced ash, volatiles and Sulphur while increasing fixed or combustible carbon percentiles.

Example 5

A semi-bituminous sample drawn from a 'Run of Mine' (ROM) stream was collected and processed through the dedicated wash and separation process using the standard processing protocols. The features of the preprocessed ROM "Raw Feed" and the arriving processed "washed coal" had the following qualities and features:

| Raw Coal | | Washed coal | | |
|---|---|---|---|---|
| Parameter | Value Before | Value After | Difference | % Change |
| SAMPLE 1 | | | | |
| CV (Mj/kg) | 26.35 | 31.15 | +4.8 | +18 |
| Ash (%) | 24.9 | 10.0 | −14.9 | −60 |
| Volatiles (%) | 20.4 | 21.9 | +1.5 | +7 |
| Fixed Carbon (%) | 54.7 | 66.7 | +12 | +22 |
| Sulphur (%) | 2.92 | 1.44 | −1.48 | −51 |

The Particle size distribution of the ROM sample and the washed sample are detailed below:

| | Particle Size Analysis | | | | |
|---|---|---|---|---|---|
| | % | % | % | % | % |
| ROM Sample | +3 mm 0.5 | +0.5 mm 63.6 | +0.100 um 21.2 | +0.045 mm 5.0 | −0.045 mm 9.7 |
| Washed sample | +3 mm 0.7 | +0.5 mm 75.1 | +0.100 um 23.6 | +0.045 mm 0.5 | −0.045 mm 0.10 |

Aside from reducing impurities and enhancing combustibility, the technology also washed out the ultrafine particles, thereby improving the handling and further processing properties of the washed product.

While the presently preferred embodiments have been described for purposes of this disclosure, changes and modifications will be apparent to those of ordinary skill in the art. Such changes and modifications are encompassed within this invention as defined by the claims.

The invention claimed is:

1. A continuous process for beneficiating coal particulates selectively to extract and increase yield of high calorific value carbon components from undesirable fractions of a raw coal feed, the process comprising the steps of:

(a) pretreating wash water by delivering an amount of an amphipathic non-ionic surfactant to a wash water tank effective to shift the wash water to a reducing oxidation-reduction-potential such that the wash water has a pH in a range of from about 2.0 to 8.6 and an oxidation-reduction-potential of from about +200 mV to about +400 mV;

(b) introducing the raw coal feed and pretreated wash water into a primary mixing tank and washing the coal particulates with the pretreated wash water so as selectively to alter surface electrostatic charges of the coal particulates and increase their hydrophobic mobilization; and (c) separating the high calorific value carbon particulates from the wash water.

2. The process according to claim 1, wherein the raw coal feed comprises raw coal particulates, coal fines and/or coal slurry.

3. The process according to claim 1, wherein the concentration of the non-ionic surfactant in the pretreated wash water is between 0.0007% and 0.0033% v/v or between 8.86 and 33.3 ppb (parts per billion).

4. The process according to claim 1, wherein the non-ionic surfactant is an emulsifier, wetting agent and lubricant.

5. The process according to claim 3, wherein the non-ionic surfactant a short-chained, ethoxylated and propoxylated alcohol base surfactant.

6. The process according to claim 5, wherein the alcohol base surfactant has a branched and linear carbon chain length of between 12 and 15 molecules.

7. The process according to claim 1, wherein the pretreated wash water is admixed with the raw coal particulate feed such that the coal-wash water slurry after addition of the pretreated wash water has a pH in a range of from about 2.0 to about 8.5 and an oxidation-reduction-potential of from about +500 mV to about +600 mV.

8. The process according to claim 1, wherein the pretreated wash water is admixed with the raw coal particulate feed so as to create a coal-wash water slurry mass percentage of approximately 4:1 and 6:1 solids to water ratio, and approximately 80% w/v to 86% w/v solids by weight.

9. The process according to claim 1, wherein the raw coal particulate feed is admixed with the pretreated wash water at a rate of between approximately 4:1 and 6:1, and volume supply of between approximately 20% w/v and 14% w/v.

10. The process according to claim 1, wherein the process includes the additional steps of:

(i) vigorously agitating a coal-wash water slurry within the primary mixing tank;

(ii) transferring the coal-wash water slurry to a primary gravitational separator for primary separation of high calorific value coal particulates of more than 100 micrometers from smaller particles low calorific value discards; and (iii) transferring the high calorific value coal particulates to a primary high frequency resonance screen having a mesh size of no more than 100 micrometers for further dehydrating and separating high calorific value coal particulates from any remaining pretreated wash water and particulates of less than 100 micrometers.

11. The process according to claim 10, wherein the coal-wash water slurry within the primary mixing tank is agitated at a frequency of approximately 900 RPM for a period of approximately 60 seconds to 90 seconds.

12. The process according to claim 10, wherein the coal-wash water slurry is introduced into the primary gravitational separator at a material feed rate of approximately 1 ton to 120 tons per hour.

13. The process according to claim 10, wherein the primary gravitational separator is a wet spiral separator having a cutter bar position set at approximately 100 micrometers and which is set to a separation specific gravity of 1.2 maximum.

14. The process according to claim 10, wherein the process provides assembling a number of primary spiral separators, either in series or parallel, for processing the pretreated water and coal slurry flow from the primary mixing tank across the primary high frequency resonance screen for separation of high calorific value coal particulates of more than 100 micrometers from smaller particles of low calorific value discards.

15. The process according to claim 10, wherein the process provides the additional steps of:

(iv) introducing the high calorific value coal particulates that are collected from the primary high frequency resonance screen into a secondary mixing tank and washing the so-collected high calorific value coal particulates with pretreated or untreated wash water during a continuous secondary beneficiation stage; and (v) further separating the high calorific value carbon particulates from the wash water.

16. The process according to claim 15, wherein the process includes the additional steps of—

(vi) vigorously agitating the high calorific value carbon particulates and pretreated or untreated wash water slurry within the secondary mixing tank;

(vii) transferring the high calorific value carbon particulates and wash water slurry to a secondary gravitational separator for secondary separation of high calorific value coal particulates of more than 100 micrometers from smaller particles of low calorific value discards; and (viii) transferring the high calorific value coal particulates to a secondary high frequency resonance screen having a mesh size of no more than 100 micrometers for further dehydrating and separating high calorific value coal particulates from any remaining wash water and particulates of less than 100 micrometers.

17. The process according to claim 16, wherein the coal-wash water slurry within the secondary mixing tank is agitated for a period of approximately 90 seconds.

18. The process according to claim 16, wherein the coal-wash water slurry is introduced into the secondary gravitational separator at a material feed rate of a minimum of 1 ton per hour.

19. The process according to claim 16, wherein the secondary gravitational separator is a wet spiral separator having a cutter bar position set at approximately 100 micrometers and which is set to a separation specific gravity of 1.2 maximum.

20. The process according to claim 16, wherein the process provides assembling a number of secondary spiral separators, either in series or in parallel, and running an output of a first spiral separator through a second separator for further secondary separation of high calorific value coal particulates of more than 100 micrometers from smaller particles low calorific value discards.

21. The process according to claim 16, wherein the further step of transferring spent wash water to an underflow tailings tank; allowing the spent wash water to settle so as to separate fine coal particulates and ash from the wash water; and reintroducing the so-separated wash water back into the beneficiation process of the invention.

22. A batch process for beneficiating high calorific value coal particulates from undesirable fractions of a raw coal feed, the process comprising the steps of:

(a) pretreating wash water by delivering an amount of an amphipathic non-ionic surfactant to a wash water tank effective to shift the wash water to a reducing oxidation-reduction-potential such that the wash water has a pH in a range of from about 2.0 to about 8.6 and an oxidation-reduction-potential of from about +200 mV to about +400 mV;

(b) introducing the raw coal feed and pretreated wash water into a primary mixing tank and washing the coal particulates with the pretreated wash water so as selectively to alter surface electrostatic charges of the coal particulates and increase their hydrophobic mobilization;

(c) transferring the coal-wash water slurry to a primary gravitational separator for primary separation of high calorific value coal particulates of more than 100 micrometers from smaller particles of low calorific value discards;

(d) transferring the high calorific value coal particulates to a primary high frequency resonance screen having a mesh size of no more than 100 micrometers for further dehydrating and separating high calorific value coal particulates from any remaining pretreated wash water and particulates of less than 100 micrometers;

(e) introducing the high calorific value coal particulates that are collected from the primary high frequency resonance screen back into the primary mixing tank and washing the so-collected high calorific value coal particulates with pretreated or untreated wash water during a secondary beneficiation stage; and (f) separating the high calorific value carbon particulates from the wash water through the primary gravitational separator and primary high frequency resonance screen.

23. A process for beneficiating high value particulates to selectively extract and increase yield of high value mineral components from undesirable fractions of a raw mineral feed, the process comprising the steps of:

(a) pretreating wash water by delivering an amount of an amphipathic non-ionic surfactant to a wash water tank effective to shift the wash water to a reducing oxidation-reduction-potential such that the wash water has a pH in a range of from about 2.0 to about 8.6 and an oxidation-reduction-potential of from about +200 mV to about +400 mV;

(b) introducing the raw mineral feed and pretreated wash water into a primary mixing tank and washing the mineral particulates with the pretreated wash water so as selectively to alter surface electrostatic charges of the mineral particulates and increase their hydrophobic mobilization; and (c) separating the high value mineral particulates from the wash water.

24. The process according to claim 23, wherein the raw mineral feed comprises high value non-calorific particulates selected from the group consisting gold, silver, platinum group metals (PGMs), zinc and chromium.

25. The process according to claim 23 wherein the process includes the additional steps of:

(i) vigorously agitating a minerals-wash water slurry within the primary mixing tank;

(ii) transferring the minerals-wash water slurry to a primary gravitational separator for primary separation of high value mineral particulates from smaller particles of low value discards; and (iii) transferring the high value mineral particulates to a primary high frequency resonance screen for further dehydrating and separating high value mineral particulates from any remaining wash water and undesirable small particulates.

26. The process according to claim 25, wherein the process includes pr vidcs the additional steps of:

(iv) introducing the high value mineral particulates that are collected from the primary high frequency resonance screen into a secondary mixing tank and washing the so-collected high value mineral particulates with pretreated or untreated wash water during a secondary beneficiation stage; and (v) separating the high value mineral particulates from the wash water.

27. The process according to claim 26, wherein the process includes the additional steps of:

(vi) vigorously agitating the high value mineral particulates and wash water slurry within the secondary mixing tank;

(vii) transferring the high value mineral particulates and wash water slurry to a secondary gravitational separator for secondary separation of high value mineral particulates from smaller particles low value discards; and (viii) transferring the high value mineral particulates to a secondary high frequency resonance screen [30] for further dehydrating and separating high value mineral particulates from any remaining wash water and smaller particulates.

28. A beneficiation equipment assembly suitable for use in a process for beneficiating coal particulates to selectively extract and increase yield of high calorific value carbon components from undesirable fractions of a raw coal feed, the equipment assembly comprising:

a pretreatment wash water tank for pretreating wash water;

a primary mixing tank arranged in flow communication with the pretreatment wash water tank and configured for receiving the raw coal feed and pretreated wash water;

an agitator operatively associated with the primary mixing tank and configured for washing the coal particulates with the pretreated wash water so as selectively to alter surface electrostatic charges of the coal particulates and increase their hydrophobic mobilization;

a primary gravitational separator arranged in flow communication with the primary mixing tank for primary separation of high calorific value coal particulates of more than 100 micrometers from smaller particle low calorific value discards;

a primary high frequency resonance screen arranged in flow communication with the primary gravitational separator and having a mesh size of no more than 100 micrometers for further dehydrating and separating high calorific value coal particulates from any remaining wash water and particulates of less than 100 micrometers; and an underflow tailings tank arranged in flow communication with the primary gravitational separator and primary high frequency resonance screen for receiving spent wash water.

29. The equipment assembly according to claim 28, wherein the primary gravitational separator is a wet spiral separator having a cutter bar position set at approximately 100 micrometers and which is set to a separation specific gravity of 1.2 maximum.

30. The equipment assembly according to claim 28, wherein the assembly includes a number of primary spiral separators such that an output of a first spiral separator is run through a second separator for further primary separation of high calorific value coal particulates of more than 100 micrometers from smaller particles low calorific value discards.

31. The equipment assembly according to claim 28, wherein the assembly further comprises:

a secondary wash water tank containing either pretreated or untreated wash water;

a secondary mixing tank arranged in flow communication with the secondary wash water tank and the primary high frequency resonance screen and configured for receiving the high calorific value coal particulates that are collected from the primary high frequency resonance screen into the secondary mixing tank;

an agitator operatively associated with the secondary mixing tank and configured for washing the collected high calorific value coal particulates with pretreated or untreated wash water;

a secondary gravitational separator arranged in flow communication with the secondary mixing tank for secondary separation of high calorific value coal particulates of more than 100 micrometers from smaller particles low calorific value discards;

a secondary high frequency resonance screen arranged in flow communication with the secondary gravitational separator and having a mesh size of no more than 100 micrometers for further dehydrating and separating high calorific value coal particulates from any remaining wash water and particulates of less than 100 micrometers; and an underflow tailings tank arranged in flow communication with the secondary gravitational separator and secondary high frequency resonance screen for receiving spent wash water.

32. The equipment assembly according to claim 28, wherein the equipment assembly is in the form of a mobile rig.

33. Pretreated wash water adapted for use in a process for beneficiating coal particulates from a raw coal feed, the pretreated wash water including an amount of an amphipathic non-ionic surfactant effective to shift the wash water to a reducing oxidation-reduction-potential such that the wash water has a pH in a range of from about 2.0 to about 8.6 and an oxidation-reduction-potential of from about +200 mV to about +400 mV.

34. The pretreated wash water according to claim 33, wherein the non-ionic surfactant is an emulsifier, wetting agent and lubricant.

35. The pretreated wash water according to claim 34, wherein the non-ionic surfactant a short-chained, ethoxylated and propoxylated alcohol base surfactant.

36. The pretreated wash water according to claim 35, wherein the alcohol base surfactant has a branched and linear carbon chain length of between 12 and 15 molecules.

37. The pretreated wash water according to claim 33, wherein the concentration of the non-ionic surfactant in the pretreated wash water is between 0.0007% and 0.0033% v/v or between 8.86 and 33.3 ppb (parts per billion).

38. A high calorific value carbonaceous fuel comprising high calorific value carbon particulates extracted from a raw coal feed according to the process of claim 1.

39. A high calorific value carbonaceous fuel comprising high calorific value carbon particulates extracted from a raw coal feed through use of the equipment assembly according to claim 28.

40. A high calorific value carbonaceous fuel comprising high calorific value carbon particulates extracted from a raw coal feed through use of pretreated wash water according to claim 33.

* * * * *